US005416499A

United States Patent [19]

Ohtsu

[11] Patent Number: 5,416,499

[45] Date of Patent: May 16, 1995

[54] BIT MAP DISPLAY CONTROLLING APPARATUS

[75] Inventor: Kenji Ohtsu, Tokyo, Japan

[73] Assignee: Matsushita Electric Industrial Co., Ltd., Osaka, Japan

[21] Appl. No.: 959,514

[22] Filed: Oct. 13, 1992

Related U.S. Application Data

[63] Continuation-in-part of Ser. No. 768,297, Oct. 4, 1991.

[30] Foreign Application Priority Data

Feb. 26, 1990 [JP] Japan ..... 2-044890

[51] Int. Cl.[6] ..... G09G 1/16

[52] U.S. Cl. ..... 345/189; 345/190

[58] Field of Search ..... 340/799, 798, 750; 345/189, 190, 425, 87, 97

[56] References Cited

U.S. PATENT DOCUMENTS 4,604,615 8/1986 Funahashi ..... 340/798
4,704,497 11/1987 Kiremidjian et al. ..... 340/798
4,748,444 5/1988 Arai ..... 345/99
4,758,881 7/1988 Laspada ..... 340/798
4,942,389 7/1990 Hinami ..... 340/799

FOREIGN PATENT DOCUMENTS 0256879 2/1988 European Pat. Off. ..... 345/97
60-191349 9/1985 Japan .

*Primary Examiner*—Ulysses Weldon
*Assistant Examiner*—Amare Mengistu
*Attorney, Agent, or Firm*—Stevens, Davis, Miller & Mosher

[57] ABSTRACT

The present invention provides a control apparatus for a video display which can change the order of addresses of a video memory (2) as desired, and there is provided an address translator which is written with a translation data of an address from CPU (3) for accessing the video memory (2), the translation data representing addresses generated by a display controller (1) sequentially in the order of laster scanning and being changed with the contents to be written in the video memory (2), and outputs the translation data as a translated address of the address from CPU (3) to the video memory (2).

1 Claim, 3 Drawing Sheets

| | | |
|---|---|---|
| 0 | ADDRESS | 0 |
| 1 | ADDRESS | 128 |
| 2 | ADDRESS | 256 |
| 3 | ADDRESS | 384 |
| 4 | ADDRESS | 512 |
| 5 | ADDRESS | 640 |
| 6 | ADDRESS | 768 |
| 7 | ADDRESS | 894 |

FIG. 3A
| | |
|---|---|
| 0 ADDRESS | 00010000 |
| 1 ADDRESS | 00101000 |
| 2 ADDRESS | 01000100 |
| 3 ADDRESS | 01000100 |
| 4 ADDRESS | 01111100 |
| 5 ADDRESS | 11000110 |
| 6 ADDRESS | 10000010 |
| 7 ADDRESS | 10000010 |
FIG. 3B
| | |
|---|---|
| 0 ADDRESS | 00010000 |
| 128 ADDRESS | 00101000 |
| 256 ADDRESS | 01000100 |
| 384 ADDRESS | 01000100 |
| 512 ADDRESS | 01111100 |
| 640 ADDRESS | 11000110 |
| 768 ADDRESS | 10000010 |
| 894 ADDRESS | 10000010 |
FIG. 4
PRIOR ART
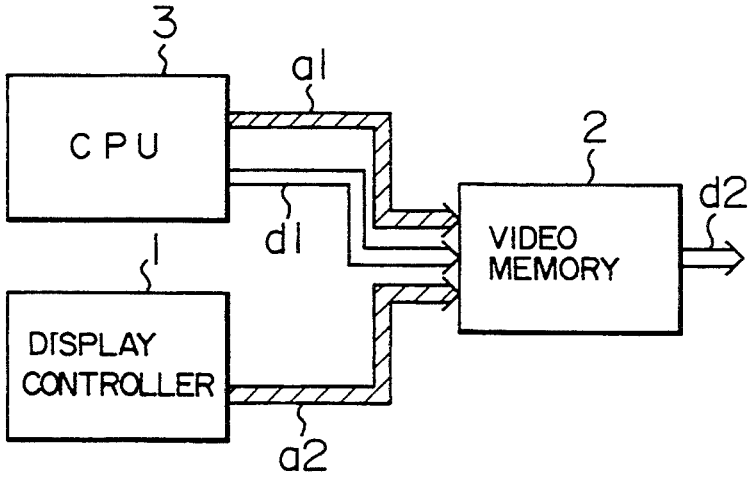
FIG. 5
PRIOR ART
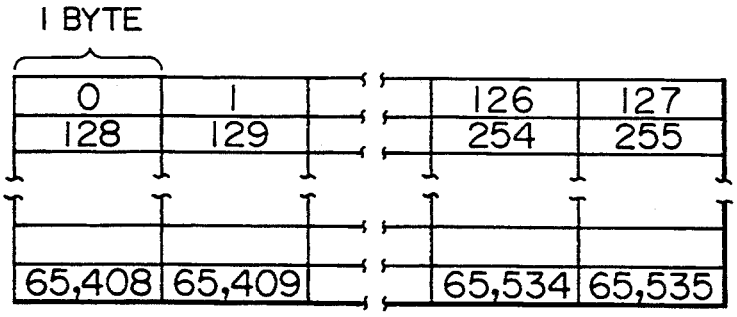

BIT MAP DISPLAY CONTROLLING APPARATUS

This is a continuation-in-part of U.S. application Ser. No. 07/768,297, filed Oct. 4, 1991.

TECHNICAL FIELD

The present invention relates to a bit map display controlling apparatus used with a word processor, personal computer, data terminal equipment or the like.

BACKGROUND ART

In a conventional bit map display controlling apparatus of this type, addresses of a video memory are assigned sequentially in the order of raster scanning, and a display controller accesses the video memory in the order of addresses to perform a refresh display of the contents of the video memory.

Addresses of the video memory as seen from a central processing unit (hereinafter called a CPU) are also assigned in the above-described manner. FIG. 4 shows the structure of a conventional bit map display controlling apparatus. In FIG. 4, a display controller 1 generates addressess a2 for reading to the video memory 2 sequentially in the order of raster scanning and supplies them to a video memory 2 storing the laster scan type display contents. The video memory 2 outputs display data d2 in the order of raster scanning.

CPU 3 accesses, when necessary, the video memory 2 fixedly assigned with the addresses in the order of raster scanning, and changes the data in the video memory 2 to a data d1.

FIG. 5 shows an example of an address map of the video memory 2 of a conventional bit map display controlling apparatus. This example of FIG. 5 is applied to a bit map display controlling apparatus wherein 1024 dots are scanned in the horizontal direction, and 512 dots are repeatedly scanned (having 512 scan lines) in the vertical direction. Byte addresses are sequentially assigned in the horizontal direction on the 8 dots (bits) unit basis. Numbers in FIG. 5 represent the byte addresses.

The numbers of dots in the horizontal and vertical directions may vary depending upon a bit map display controlling apparatus. However, in general, the address assignment of a conventional bit map display controlling apparatus is in the order of raster scanning such as shown in FIG. 5.

The above-described conventional bit map display controlling apparatus is, however, associated with a problem that in writing data into the video memory under control of CPU 3, an address translation calculation to be executed by a program may sometimes become complicated depending upon the contents of the data, because the addresses of the video memory 2 are fixedly assigned, thereby increasing the processing time and the quantity of program.

Consider for example the case where a program of CPU 3 reads a character "A" composed of 8 bits in the horizontal direction and 8 bits in the vertical direction as shown in FIG. 3(*a*), from a character generator at addresses from 0 to 7, and writes the character data in the video memory at addresses from 0 to 896 at the interval of every 128-th address. In this case, although the consecutive 8 bytes are accessed for reading the data on the side of the character generator data writing on the side of the video memory requires an address addition calculation for each byte by using a program, because the corresponding addresses of the video memory are not consecutive.

The present invention solves such conventional problems and aims at providing a bit map display controlling apparatus wherein in writing data in a video memory by using a program of CPU, the addresses generated by a display controller sequentially in the order of raster scanning can be translated as desired depending upon the contents of the data so as to satisfy the program, thereby reducing the load on the program of CPU.

DISCLOSURE OF THE INVENTION

In order to achieve the above object of the present invention, an address translator is provided for reducing the load of a program of CPU. The address translator enables the CPU to arbitrarily change beforehand the order of addresses of a video memory, which have been generated by a display controller and which have been fixed in the order of a raster scan, when accessing the video memory from the CPU. Thus, the load of program of CPU can be reduced.

According to the present invention, an address from CPU for accessing the video memory is translated by the address translator, and thereafter the video memory is accessed using the translated address. Therefore, in writing data in a video memory using a program of CPU, the video memory address can be accessed most properly for the program of CPU in accordance with the contents of the data to be written.

BRIEF DESCRIPTION OF THE DRAWINGS

FIG. 4 is a block diagram showing a conventional bit map display controlling apparatus, FIG. 5 illustrates an address assignment of a video memory in a conventional bit map display controlling apparatus.

BEST MODE FOR CARRYING OUT THE INVENTION

Figures 1, 2:
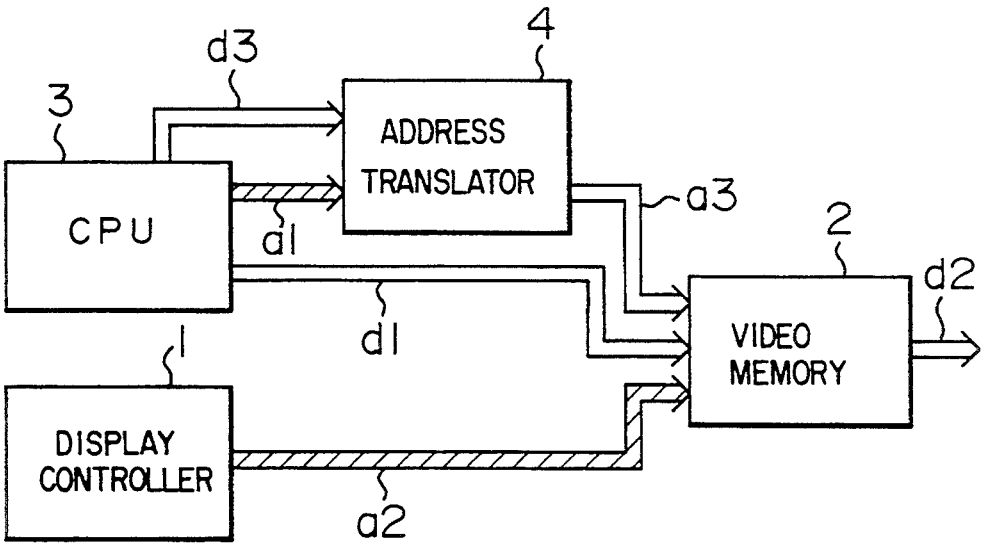
FIG. 1 is a block diagram showing a bit map display controlling apparatus according to an embodiment of the present invention.
FIG. 2 is a diagram illustrating the correspondence between addresses and their contents in an address memory of the address translator of the apparatus shown in FIG. 1, FIG. 3(*a*) is a diagram showing addresses and their contents read from a character generator of the apparatus shown in FIG. 1, FIG. 3(*b*) is a diagram showing addresses of a video memory corresponding to the addresses shown in FIG. 3(*a*), and their contents.

FIG. 1 shows the structure of an embodiment of the present invention. In FIG. 1, reference numeral 1 represents a display controller which generates an address signal a2 sequentially in the order of raster scanning for accessing a video memory 2 storing the raster scan type display contents, and supplies it to the video memory 2 to access it.

d2 represents a display data output from the video memory 2 when the display controller 1 accesses the video memory 2.

Reference numeral 3 represents a stored-program type CPU which outputs a data d1 to be written in the video memory 2.

Reference numeral 4 represents an address translator which is constructed of a random access memory. In this address translator 4, CPU 3 writes in advance an address translation data d3 for an address a1 to be outputted from CPU 3 for accessing the video memory 2. The address translator 4 outputs an address a3 as a translated address of the address a1 for accessing the video memory 2.

FIG. 2 shows the contents of the address translation data d3 output from CPU 3 and written in the address translator 4 for addresses "0" to "7" designated by the address a1 output from CPU 3.

FIG. 3(*a*) shows the contents of a character "A" to be read from a character generator read-only memory (not shown) at addresses from "0" to "7". Fig. 3(*b*) shows the read-out contents of FIG. 3(*a*) written in the video memory 2 at addresses from "0" to 896 at the interval of every 128-th addresses.

The addresses from "0" to "894" shown in FIG. 3(*b*) correspond to the addresses of the video memory 2 assigned with byte addresses on the 8 bits unit basis in the horizontal direction shown in FIG. 5.

The operation of the above-described embodiment will be described next. In the embodiment, the display controller 1 generates the address a2 in the order of raster scanning for accessing the video memory 2. The video memory 2 outputs the display data d2 in the order of raster scanning.

CPU 3 changes the data assigned fixedly and in the order of raster scanning to the video memory 2, to the data d1. The above operation is the same as that of a conventional apparatus.

Next, the operation of the address translator 4 will be described. In writing data in the video memory 2 using a program of CPU 3, the address translator 4 translates the address a1 accessed by CPU 3 to the address a3 such that the address generated by the display controller 1 in the order of raster scanning can be translated as desired in accordance with the contents of the data to be written so as to satisfy the program of CPU 3.

In this case, CPU 3 writes in advance the address translation data d3.

In data writing, the corresponding addresses of the video memory 2 are written in the address translator 4 at addresses "0" to "7" as shown in FIG. 2.

This pre-process allows the following operation. Consider the case where CPU 3 reads a character (e.g., "A") composed of 8 bits in the horizontal direction and 8 bits in the vertical direction as shown in FIG. 3(*a*) from a character generator memory at addresses "0" to "7" and writes it in the video memory 2 at addresses from "0" to "896" at the interval of every "128-th" addresses as shown in FIG. 3(*b*). In this case, the address translator 4 outputs the address a3 to the video memory 2 so that the video memory 2 can be accessed by using consecutive addresses as apparent addresses from "0" to "7" as viewed from the CPU.

Specifically, CPU 3 reads the character generator at addresses from "0" to "7", and writes the data d1 in the video memory 2 at the addresses from "0" to "896" at the interval of every "128-th" addresses. In reading the character generator read-only memory, the consecutive 8 bytes are accessed, and also in writing into the video memory 2, the consecutive addresses for the addresses from "0" to "7" can be accessed.

According to the present embodiment, therefore, if for example a display area is divided into areas for character data and image data which are displayed at the same time, the address translator 4 constructed of a random access memory may be written such that address translation data is provided for the character display area as in the above embodiment, and address translation data is not provided for the image display area.

Furthermore, in the case where characters of different sizes are displayed at the same time, translated addresses corresponding to the positions of characters to be displayed can be properly determined as desired in accordance with the sizes of characters and stored in the address translator 4.

Still further in the case that the same character pattern or image is copied to another position of the same display screen, the pattern or image can be copied not by accessing the video memory 2 but by accessing only the address translator 4 constructed of a random access memory.

The above embodiment will further be described using a particular example of an image on the screen.

It is assumed that n lines of $8\times8$ dot characters are displayed on the upper area of a display screen, and a figure is displayed on the area under the upper area.

In such a case, for a program of CPU 3, it is preferable that the character pattern for each character on the character area can be written using consecutive addresses, and that the figure can be written using addresses of the video memory 2 without translation ("preferable" means that a program can be made which is easy to understand and easy to speed up the access time).

According to the present invention, such a preferable condition can be easily realized by properly writing the contents of the address translator 4 constructed of a random access memory.

Namely, as the contents of the address translator 4 constructed of a random access memory for the n line character display area, addresses those starting from 0 and following integer multiples of 128 such as explained with FIG. 2 are written in the address translator 4 constructed of a random access memory.

As the contents of the address translator 4 constructed of a random access memory for the display area other than the character display area, the same addresses for the video memory are written.

As described above, according to the present invention, using the contents of the address translator 4 constructed of a random access memory, the order of addresses of the video memory 2 can be changed as desired most properly for an image display program. Easy programming and high speed processing can be effectively realized for a bit map display controlling apparatus which displays freely a complicated combination of characters of desired sizes, figures, and graphics images.

Figure 6:
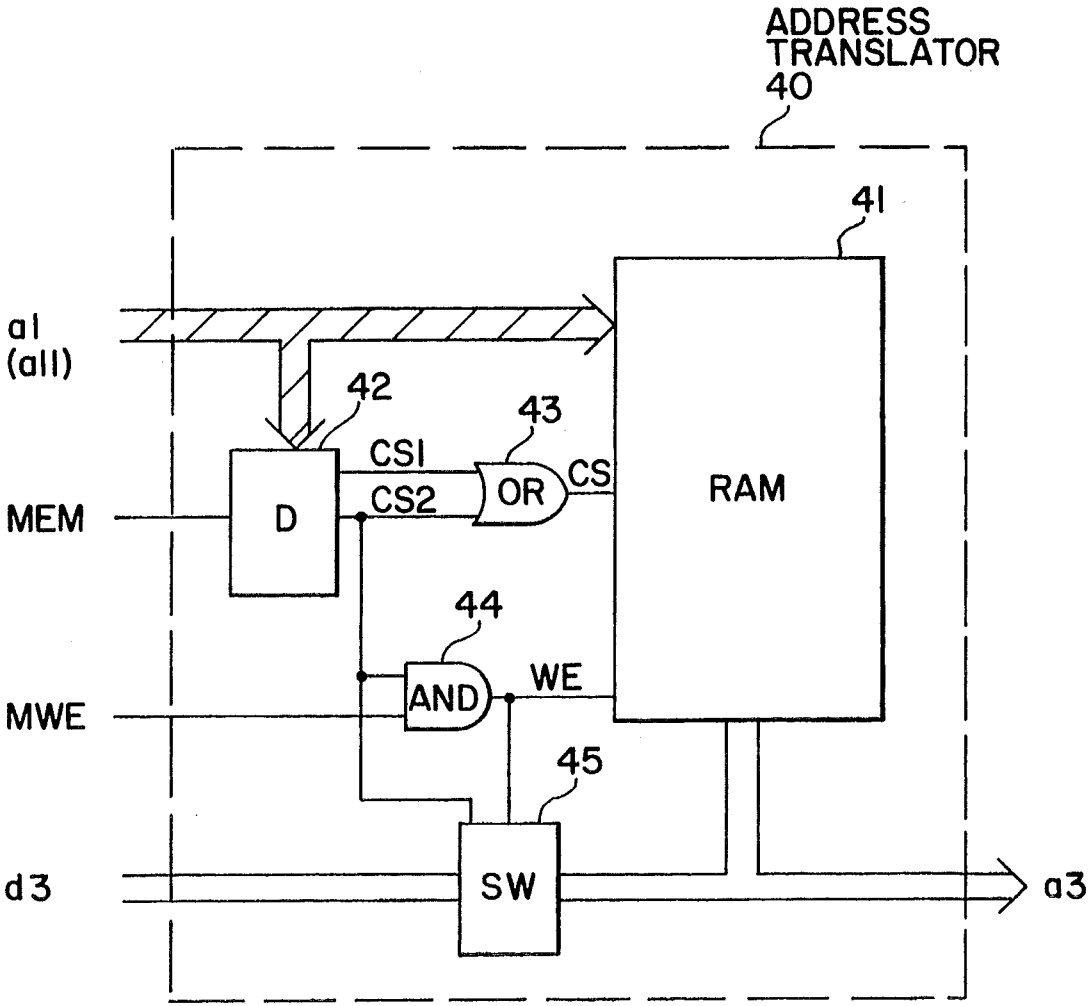
FIG. 6 shows an address translator in another embodiment of the invention.

FIG. 6 illustrates an address translator 40 in another embodiment of the present invention.

With reference to FIG. 6, the address translator 40 includes a RAM (random access memory) 41, an address decoder 42, an OR circuit 43, an AND circuit 44, and a bidirectional bus-switching circuit 45. A CPU 3 (FIG. 1) supplies a memory address signal a1 (corresponding to a1 in FIG. 1), and a data signal d3 (corresponding to d3 in FIG. 1) for exchanging data between the CPU 3 and the address translator 40. The CPU 3 further supplies a memory-access signal MEM and a memory-write signal MWE to the address translator 40. The address translator 40 supplies a memory address signal a3 (corresponding to a3 in FIG. 1) to a video memory 2 (FIG. 1).

First, the operation of writing the address data to be translated to the RAM 41 of the address translator 40 from the CPU 3 will be described with reference to FIG. 6.

The CPU 3 supplies to the address translator 40 the memory address signal for a1 for designating an arbitrary address of the RAM 41, the memory-access signal MEM and the memory write signal MWE. The address decoder 42 receives and decodes the memory-access signal MEM and the memory address signal a1, and generates a chip select signal (S2) for selecting a chip of the RAM 41, which signal indicates that there is a request for writing data to the RAM 41 or for reading data from the RAM 41 to the CPU 3. The AND circuit 44 receives the chip select signal CS2 and the memory write signal MWE to perform AND processing, and delivers a write signal WE to the RAM 41. On the other hand, the chip select signal CS2 is also supplied to the OR circuit 43, and a chip select signal CS is delivered to the RAM 41. Furthermore, the CPU 3 supplies to the address translator 40 the data signal d3 which is to be written to the RAM 41. The bus switching circuit 45 is enabled upon receiving the chip select signal CS2, and transfers the data signal d3 to the a3 signal side in accordance with the write signal WE so that the data signal d3 becomes a data input signal to the RAM 41. By the operation described above, the CPU 3 writes arbitrary data at an arbitrary address of the RAM 41 in the address translator 40.

Next, the address translation operation performed by the address translator 40 when the CPU 3 (FIG. 1) writes data to the video memory 2 (FIG. 1) will be described with reference to FIG. 6.

The CPU 3 supplies an address signal all for designating an arbitrary address of the video memory 2, the memory-access signal MEM and the memory-write signal MWE to the address translator 40. The address decoder 42 receives and decodes the memory-access signal MEM and the address signal all, and delivers a chip select signal CS1 for selecting a chip of the video memory 2, which signal indicates that the video memory is to be accessed. The chip select signal CS1 passes though the OR circuit 43 and the chip select signal CS for the RAM 41 is delivered. Since the write signal WE to the RAM 41 is not generated from the AND circuit 44, the operation of the RAM 41 is in a read mode, and the RAM 41 outputs data signal a3 in accordance with the memory address signal a1 from the CPU 3. Furthermore, since the bus switching circuit 45 remains disabled, the data signal d3 is not transferred to the side of the a3 signal.

By the operation described above, the address signal all supplied from the CPU 3 for video memory accessing is converted or translated into the memory address signal a3 for the video memory 2, and this memory address signal a3 is input to the video memory 2 as address data.

In the foregoing description, the address of the RAM 41 and the address of the video memory 2 are different in the most significant bit and the rest of the address bits are common. Furthermore, when supplementing the description of FIG. 1, the data signal d1 and the data signal d3 are common signals within the CPU 3 (these signals are described as different signals for the sake of convenience).

INDUSTRIAL APPLICABILITY

As apparent from the above-described embodiment of the present invention, in writing data in a video memory using a program of CPU, CPU writes a translation data of an address from CPU for accessing the video memory, into an address translator. The address translator outputs a translated address of the address from CPU to the video memory. Thus, the address from CPU can be changed as desired so as to satisfy the program, thereby reducing the load of the CPU program.

I claim:

1. A bit map display controlling apparatus for use with a device comprising a central processing unit, said apparatus comprising:

a video memory for storing raster scan type display contents, data in said video memory being changed as desired by said central processing unit as said central processing unit executes a program;

a display controller for generating a signal and address for accessing said video memory in a predetermined order, synchronously with raster scanning; and an address translator for (a) translating as desired, when said central processing unit writes data in said video memory in accordance with said program, addresses in the order of raster scanning in accordance with the contents of said data so as to satisfy said program, and (b) supplying addresses for accessing said video memory;

said address translator comprising:

a random-address memory;

address decoding means for selecting an area of said random-access memory to receive data from said central processing unit;

bus switching means, responsive to a memory write signal input to said address translator from said central processing unit, for passing a write data signal output by said central processing unit to said random-access memory when said memory write signal is in an on state and for passing a read data signal output by said random-access memory to said video memory when said memory write signal is in an off state; and gate means for inputting a chip select signal generated by said address decoding means into said random-access memory to store said write data signal in an arbitrary position in said random-access memory selected by said address decoding means, wherein each of said addresses for accessing said video memory and a corresponding address of said random-access memory are different in their most significant bits and are equal in all other bits, and wherein said write data signal output by said central processing unit is equal to a data signal output by said central processing unit directly to said video memory.

* * * * *